US005377980A

United States Patent [19]

Hannon et al.

[11] Patent Number: 5,377,980

[45] Date of Patent: Jan. 3, 1995

[54] GOLF CLUB WITH LOCKABLE HEAD-TO-SHAFT ANGLE ADJUSTMENT

[75] Inventors: Richard H. Hannon, Oceanside; Jacob H. Schmidt, Jr., Cardiff, both of Calif.

[73] Assignee: Plop Golf Company, Carlsbad, Calif.

[21] Appl. No.: 206,734

[22] Filed: Mar. 7, 1994

Related U.S. Application Data

[63] Continuation-in-part of Ser. No. 48,295, Apr. 19, 1993, Pat. No. 5,292,123.

[51] Int. Cl.[6] ..... A63B 53/02

[52] U.S. Cl. ..... 273/80.2; 273/80 C; 273/167 G; 273/167 H

[58] Field of Search ..... 273/167 G, 167 H, 80 C, 273/80.1, 80.2, 80.3, 80.4, 80.5, 80.6, 80.7, 80.8, 80 B, 167 A, 77 R

[56] References Cited

U.S. PATENT DOCUMENTS

| | | | |
|---|---|---|---|
| 2,520,702 | 8/1950 | Verderber | 273/79 |
| 2,530,446 | 11/1950 | Beardsley | 273/79 |
| 2,661,952 | 12/1953 | Jackson | 273/80.1 |
| 3,601,399 | 8/1971 | Agens | 273/79 |
| 4,815,740 | 3/1989 | Williams | 273/80.1 |
| 5,292,123 | 3/1994 | Schmidt | 273/80.2 |

*Primary Examiner*—Sebastiano Passaniti

*Attorney, Agent, or Firm*—Gilliam, Duncan, Harms

[57] ABSTRACT

A golf club having a mechanism permitting adjustment of the shaft angle relative to the club head. Fixed stops limit the range of angular adjustment. The body of the club head has a central opening extending to the sole of the club. The opening is closed by a sole plate that requires a special tool for removal and reinstallation. A serrated surface secured to an extension of the club shaft within the opening mates with a corresponding serrated surface secured to the club head. The angle of the shaft relative to the head is locked by installing the sole plate which forces the two serrated surfaces together. In order to change the shaft-to-head angle, the sole plate must be loosened sufficiently to permit the cooperating serrations to disengage and be moved relative to each other.

13 Claims, 1 Drawing Sheet

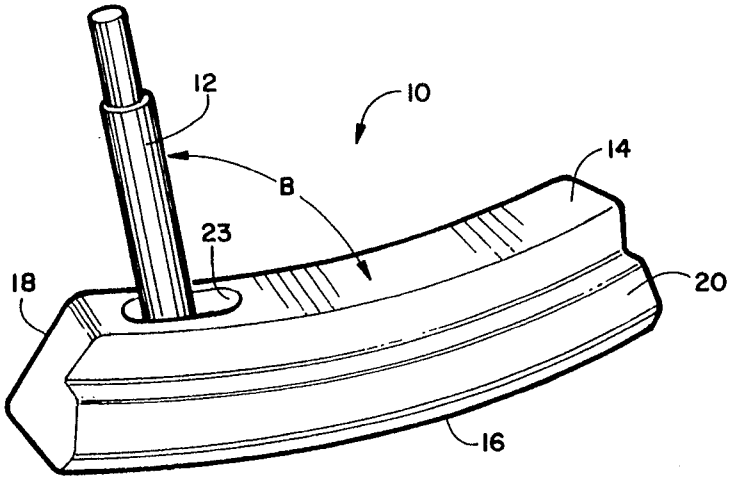
FIGURE 1
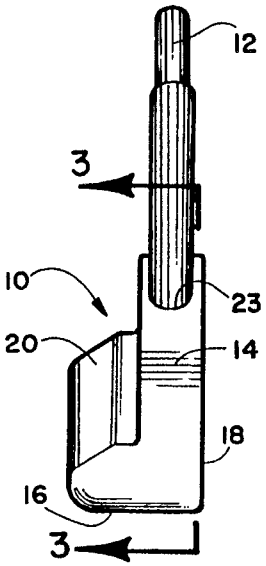
FIGURE 2
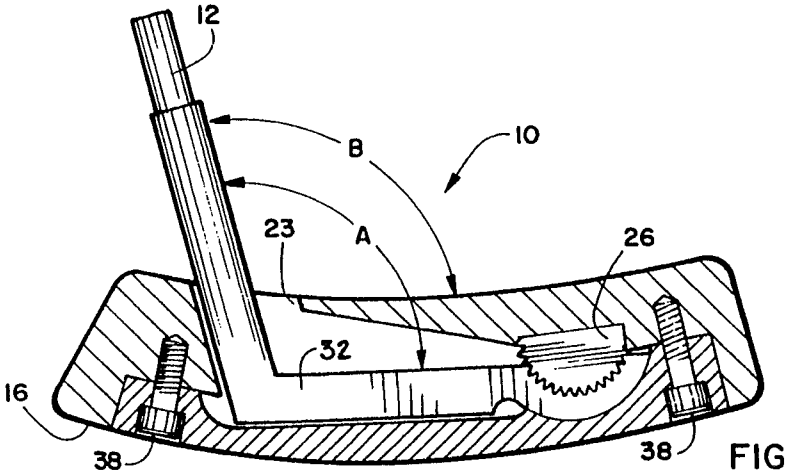
FIGURE 3
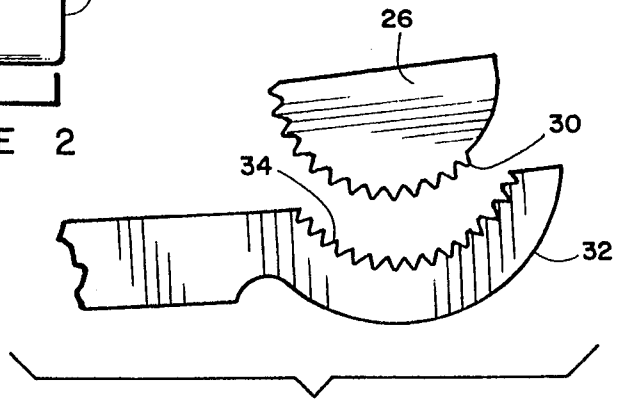
FIGURE 4
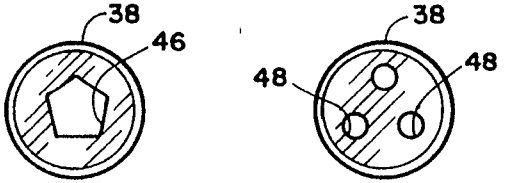
FIGURE 5
FIGURE 6

GOLF CLUB WITH LOCKABLE HEAD-TO-SHAFT ANGLE ADJUSTMENT

CROSS-REFERENCE TO RELATED APPLICATIONS

This application is a continuation-in-part of our copending U.S. patent application Ser. No. 08/048,295, filed Apr. 19, 1993 now U.S. Pat. No. 5,292,123.

BACKGROUND OF THE INVENTION

This invention relates in general to golf clubs and, more particularly, to a golf club having an adjustable shaft to head angle which.

Most golf clubs have a fixed angle between the shaft and head. While this angle is set for some hypothetical "average" golfer, it is not optimum for many golfers, who must adapt their stance to the fixed club.

Golf clubs having adjustable heads are well known and those adjustments may be various types. Examples of prior art adjustable head golf clubs employ centrally located ball joints or rotatable connections or the like to maintain club balance.

Other prior art adjustable shaft to head golf clubs have pivots between the head and shaft positioned on the distal end of the head as an extension thereof or have translatable pivots between the head and shaft. In these last mentioned clubs the club balance is changed with any selected positioning of the shaft relative to the head.

In order to comply with tournament regulations of various golf associations, it is mandatory that the relative angle between a shaft and head be fixed and not adjustable during play. The prior art adjustable golf clubs are not acceptable for use in such tournaments Thus, there is a continuing need for an adjustable golf club arrangement that maintains the club head balance through the full range of adjustment and which is capable of being locked in a selected position in a manner acceptable under general golf tournament rules.

SUMMARY OF THE INVENTION

The above noted problems, and others, are overcome by the golf club and club adjustment mechanism of this invention, which basically includes a club head have the usual external shape of a golf club and a shaft secured to the head, the head having a lengthwise cavity extending upwardly from the bottom surface of the club head. The club shaft enters the cavity through a on opening in the top surface near a first end of the head.

An element having a convex, serrated, end extends downwardly into the second end region of the cavity. An extension secured to the end of the shaft, preferably at an angle greater than about 90°, extends along the cavity. The extension has a serrated recess, conforming in shape to the element end, adjacent to the element end. The shaft and extension unit is pivotable about the center of the convex end between stops to select the desired angle between shaft and head.

When the desired angle is selected, a sole plate is fastened to cover the cavity opening in the bottom of the head and press the extension recess tightly against the convex element end. The interlocking serrations lock the head to the shaft extension, preventing undesired relative movement in use. To change the shaft-to-head angle, the soleplate is loosened or removed, the shaft is moved to the desired angle and the soleplate is tightened.

The position of the cooperating element end and extension recess is selected so that the balance of the club does not change as the shaft angle is changed.

In some cases it is desirable to have a uniquely shaped recess in the heads of fasteners holding the sole plate to the head, so that the shaft angle cannot be changed without using a correspondingly shaped tool.

An object of this invention is to provide a regulation golf club which the angle between the head and shaft can be selected across a range of different angles.

Another object of the invention is to provide a regulation golf club which the relative angle between the club head and shaft can be selected between a predetermined maximum and minimum angle without changing the designed playing characteristics of the of the club.

Another object of the invention is to provide a regulation golf club in which the relative angle between the club head and shaft can be selected between a range of angles and that selected angle can be maintained during play.

Yet another object of the invention is to provide a regulation golf club which the relative angle between the club head and shaft can be selected between a range of angles and that selected angle can be changed only with a special tool.

These and other objects and advantages of the present invention will become apparent to those skilled in the art after considering the following detailed specification.

BRIEF DESCRIPTION OF THE DRAWING

Details of the invention, and of preferred embodiments thereof, will be further understood upon reference to the drawing, wherein:

FIG. 1 is a perspective view of the golf club of this invention;

FIG. 2 is an end elevation view of the golf club of FIG. 1;

FIG. 3 is a section view taken on line 3—3 in FIG. 2 showing the internal components within the golf club head;

FIG. 4 is an exploded detail view showing the cooperating locking surfaces maintaining the shaft and head a selected angle to each other.

FIG. 5 is a detail view showing one embodiment of an angle adjustment recess: and FIG. 6 is a detail view showing another embodiment of an angle adjustment recess.

DETAILED DESCRIPTION OF PREFERRED EMBODIMENTS

Referring now to FIGS. 1 and 2, there is seen a golf club head 10 with a portion of a golf club shaft 12 extending therefrom. In the embodiment shown, the club depicted is a putter for a right-handed person. Head 12 includes a curved top surface 14, a curved bottom surface 16, a flat front or ball striking surface 18 and an extended back wall 20. Shaft 12 lies at a selected angle B to head 10, entering head 12 through an opening 23, as detailed below. If desired, back wall 20 may be at least partially open, revealing the interior components. Back wall 20 need only be sufficient to maintain the interior components in place. Also, if desired a rubber boot or a flexible foam plug(not shown) may be used to seal opening 23 against the entrance of dirt or other material while allowing movement of shaft 12 between the ends of opening 23. In general, leaving opening 23 open is preferred for simplicity, particularly where the club is a putter, since entry of dirt or the like through hole 23 is not a significant problem.

FIG. 3, a section view taken on line 3—3 in FIG. 2, shows the internal components within head 10 that permit adjustment of the angle B of shaft 12 to head 10 and which lock those parts together for use.

An elongated cavity 22 extends up into head 10 through bottom surface 16. Cavity 22 has generally spaced parallel walls 24 generally parallel to front surface 18. An opening 23 extends through top surface 14 to cavity 22 to receive the end of shaft 12.

A locking element 26 has generally parallel sides that slidably fit between walls 24 and is seated in a recess 28 along the upper surface of cavity 22. A convex end 30 extends downwardly into cavity 22. Said convex end 30 has a surface that is a portion of a circle drawn about an axis generally perpendicular to front and back walls 24.

An extension 32 is fastened to the end of shaft 12 at a selected angle "A" thereto. A concave recess 34 is provided at the free end of extension 32 adjacent to, and having a surface conforming to, convex end 30. The mating surfaces of convex end 30 and concave recess 34 have patterns of matching serrations 35, preferably a pattern transverse teeth having apex angles of about 50°to 70° (ideally, about 60°), as best seen in FIG. 4. The serrations lie generally parallel to said axis about which said circle is drawn. Convex end 30 and concave recess 34 have substantially identical semi-circular cross-sections. For best results, the radius of these surfaces should be at least 0.7 inch.

The opening of cavity 22 through the bottom surface 16 of head 10 is closed by a soleplate 36. Soleplate 36 is held in place by cap screws, bolts or the like 38. When soleplate 36 is in place, an upper surface 40 presses the concave recess 34 tightly against convex end surface 30, so that the serrations thereon interlock, preventing rotation of the convex end relative to the concave recess.

The angle of shaft 12 can be adjusted relative to head 10 between limits. The largest angle "B" is provided when extension 32 contacts the stop surface 42 on soleplate 36. The smallest angle "B" is provided when shaft 12 encounters stop edge 44 of opening 23. Any angle between these stops may be selected, as desired.

The shaft angle is adjusted by loosening or removing bolts 38 to permit concave recess 34 to be slightly spaced from convex end 30, so that the surface serrations no longer interlock, allowing shaft 12 and extension 32 to rotate about an axis generally perpendicular to the elongated cavity and passing through the center of the convex surface of convex end 30. When the desired angle is reached, bolts 38 are tightened to lock in the selected angle.

The rules of many golf tournaments prohibit changing, adjusting or modifying clubs during play. In order to eliminate any temptation to change the angle of shaft 12 during play, preferably bolts 38 will have a surface having recesses shaped in a manner requiring a special tool to loosen or tighten the bolts. For example, as shown in FIG. 5, an Allen wrench type recess might be used, except that a five- or seven-sided wrench and recess might be used instead of the normal six sides. Or, as shown in FIG. 6, a pattern of round narrow holes might be provided in the bolt head, requiring a tool with a corresponding pattern of pins to engage and turn the bolts. In any of these cases, any temptation to improperly adjust the shaft angle could be avoided by not carrying the required tool during play.

While certain preferred materials, dimensions and arrangements have been detailed in conjunction with the above description of preferred embodiments, those can be varied, where suitable, with similar results. Other applications, variations and ramifications of this invention will occur to those skilled in the art upon reading this disclosure. Those are intended to be included within the scope of this invention as defined in the appended claims.

We claim:

1. A golf club having an adjustable, lockable, shaft-to-head angle which comprises:

a club head having top and bottom surfaces and an elongated cavity extending upwardly from the bottom surface of the club head;

an opening through the top surface of said club head communicating with a first end of said elongated cavity;

a locking element having a convex end extending downwardly into a second end of said elongated cavity;

said convex end having a serrated surface;

a club shaft having a first end extending into said cavity through said top surface opening;

an extension secured to said first end of said shaft at a selected angle to said shaft and extending along the length of said elongated cavity adjacent to said convex end;

said extension having a concave recess having a serrated surface complementary to the serrated surface of said convex end and lying adjacent thereto;

said convex end and said concave recess both having substantially identical partially circular cross-sections;

said shaft and said extension being pivotable about an axis generally perpendicular to the elongated cavity and passing through the center of the convex end;

stop means for limiting the pivoting of both said shaft and said extension;

a removable sole plate forming a portion of the bottom surface of said club head, closing a bottom opening of said cavity and contacting said extension opposite both said recess and said element end; and means for securing said sole plate to said club head and urging said extension recess into pressure contact with said element end.

2. The golf club according to claim 1 wherein both said convex end and said concave recess are partially circular in cross-section and have the same diameter.

3. The golf club according to claim 2 wherein said element end and said recess each has an identical diameter of about 0.75 inch.

4. The golf club according to claim 1 wherein each of said serrated surfaces comprises a pattern of adjacent V-shaped teeth having apex and groove angles of from about 50 to 70 degrees and the teeth on said element mesh with the teeth on said recess when said element and said recess are brought together.

5. The golf club according to claim 1 wherein said means for securing said sole plate to said club head comprises threaded fasteners having a recessed external head having a cross-section for receiving a correspondingly shaped threading and unthreading tool.

6. The golf club according to claim 1 wherein said stop means for limiting pivoting of said shaft includes wall means along both said cavity and said sole plate for contacting said extension to prevent further movement of said shaft and said extension.

7. The golf club according to claim 1 wherein the angle between said shaft and said extension arm is greater than 90 degrees.

8. A golf club having an adjustable, lockable, shaft-to-head angle which comprises:

a club head having top and bottom surfaces and front and back walls with an elongated cavity extending upwardly from the bottom surface of the club head between said walls;

an opening through the top surface of said club head communicating with a first end of said elongated cavity;

a locking element having a convex end extending downwardly into a second end of said elongated cavity;

said convex end having a surface that is a portion of a circle drawn about an axis generally perpendicular to said front and back walls;

said convex end having a serrated surface bearing closely spaced grooves lying generally parallel to said axis;

a club shaft having a first end extending into said cavity through said top surface opening;

an extension secured to said first end of said shaft at a selected angle to said shaft and extending along the length of said elongated cavity to said convex end;

said extension having a concave recess having a serrated surface complementary to the serrated surface of said convex end and lying adjacent thereto;

said shaft and extension being pivotable about said axis over a selected angular range;

stop means for limiting the pivoting of both said shaft and said extension;

a removable sole plate forming a portion of the bottom surface of said club head, closing a bottom opening of said cavity and contacting said extension opposite both said recess and said element end; and means for securing said sole plate to said club head and urging said extension recess into pressure contact with said element end.

9. The golf club according to claim 8 wherein the surfaces of said element end and said recess have identical diameters of at least about 0.7 inch.

10. The golf club according to claim 8 wherein each of said serrated surfaces comprises a pattern of adjacent V-shaped teeth having apex and groove angles of from about 50 to 70 degrees and the teeth on said element mesh with the teeth on said recess when said element and said recess are brought together.

11. The golf club according to claim 8 wherein said means for securing said sole plate to said club head comprises threaded fasteners having a recessed external head having a cross-section for receiving a correspondingly shaped threading and unthreading tool.

12. The golf club according to claim 8 wherein said stop means for limiting pivoting of said shaft includes wall means along both said cavity and said sole plate for contacting said extension to prevent further movement of said shaft and said extension.

13. The golf club according to claim 8 wherein the angle between said shaft and said extension arm is greater than 90 degrees.

* * * * *